US012790552B2

(12) United States Patent
Leung et al.

(10) Patent No.: US 12,790,552 B2
(45) Date of Patent: Nov. 10, 2026

(54) OXYGEN ASSISTED CRACKING OF HYDROCARBONS IN MOLTEN SALTS

(71) Applicant: Braskem America, Inc., Philadelphia, PA (US)

(72) Inventors: Samuel L. Leung, Pittsburgh, PA (US); Nicholas Wang, Pittsburgh, PA (US); Katherine McCullough, Pittsburgh, PA (US); Goutham Kotamreddy, Pittsburgh, PA (US); Charles Ambrass, Pittsburgh, PA (US); Matthew Feeney, Pittsburgh, PA (US); Jan Kalfus, Pittsburgh, PA (US); Scott Mitchell, Pittsburgh, PA (US)

(73) Assignee: Braskem America, Inc., Philadelphia, PA (US)

( * ) Notice: Subject to any disclaimer, the term of this patent is extended or adjusted under 35 U.S.C. 154(b) by 161 days.

(21) Appl. No.: 18/432,909

(22) Filed: Feb. 5, 2024

(65) Prior Publication Data

US 2024/0279557 A1 Aug. 22, 2024

Related U.S. Application Data

(60) Provisional application No. 63/483,561, filed on Feb. 7, 2023.

(51) Int. Cl.
*C10G 9/36* (2006.01)

(52) U.S. Cl.
CPC ..... *C10G 9/36* (2013.01); *C10G 2300/4006* (2013.01); *C10G 2300/4012* (2013.01);
(Continued)

(58) Field of Classification Search
CPC ..... C10G 9/36; C10G 2300/4006; C10G 2300/4012; C10G 2300/80;
(Continued)

(56) References Cited

U.S. PATENT DOCUMENTS 1,822,127 A * 9/1931 Clancy ..... C10G 9/40 502/175
3,553,279 A 1/1971 Bawa
(Continued)

FOREIGN PATENT DOCUMENTS

WO WO-0222258 A2 * 3/2002 ..... C01F 17/247
WO WO-2021/243282 A1 12/2021

OTHER PUBLICATIONS

Camara et al., "Oxidative Cracking Of Linear Hydrocarbons At Low Temperatures", Chemical Engineering Communications, vol. 198, Issue 3, pp. 416-424, published online: Nov. 25, 2010, https://doi.org/10.1080/00986445.2010.512548.
(Continued)

*Primary Examiner* — Cephia D Toomer
(74) *Attorney, Agent, or Firm* — Foley & Lardner LLP

(57) ABSTRACT

A process for the cracking of a carbon-containing feedstock to produce olefins includes contacting, in a reactor system, the carbon-containing feedstock with oxygen gas in the presence of a molten salt matrix consisting of a eutectic mixture of alkali metal carbonates, alkaline earth metal carbonates, or a mixture of any two or more thereof, to generate an olefin-containing product stream; and collecting an olefin from the olefin-containing product stream; wherein: the oxygen is fed with the carbon-containing feedstock in a gas stream comprising from greater than 0 wt % to about 21 wt % oxygen in an inert gas; the process is conducted in the absence of a catalyst comprising a transition metal, a transition metal oxide, a rare-earth metal, a rare earth metal oxide, or a combination of any two or more thereof; and the process is conducted in the absence of a glass-forming oxide.

20 Claims, 5 Drawing Sheets

(52) U.S. Cl.
CPC ..... *C10G 2300/80* (2013.01); *C10G 2400/20* (2013.01); *C10G 2400/22* (2013.01)

(58) Field of Classification Search
CPC .. C10G 2400/20; C10G 2400/22; C10G 1/10; C10G 9/34; C07C 4/025; C10B 49/14; C10B 53/07
See application file for complete search history.

(56) References Cited

U.S. PATENT DOCUMENTS

| | | | |
|---|---|---|---|
| 3,876,527 | A | 4/1975 | Dugan et al. |
| 4,882,039 | A | 11/1989 | Chen et al. |
| 2021/0371756 | A1 | 12/2021 | Pushkarev et al. |

OTHER PUBLICATIONS

Shvets et al., "Oxygen-induced Cracking Distillation of oil in the Continuous Flow Tank Reactor" International Journal Of Environmental & Science Education, 2016, vol. 11, No. 11, 4855-4868.
International Search Report and Written Opinion of PCT/US2024/014473 dtd Jun. 6, 2024.

* cited by examiner

OXYGEN ASSISTED CRACKING OF HYDROCARBONS IN MOLTEN SALTS

CROSS REFERENCE TO RELATED APPLICATIONS

This application claims the benefit of priority to U.S. Provisional Patent Application No. 63/483,561 filed Feb. 7, 2023, which is hereby incorporated by reference, in its entirety for any and all purposes.

FIELD

The present technology is generally related to the cracking of carbon-containing feedstocks. More specifically, it is related to molten salt compositions and methods of cracking in the presence of oxygen to form olefinic and aromatic monomers from a carbon-containing feedstock.

BACKGROUND OF THE INVENTION

Pyrolysis is a promising technology that can be used to produce valuable oils and light hydrocarbons in high yields from waste plastic feedstocks. In this regard, ethylene and propylene are the key feedstocks for the production of polyolefins (i.e. polyethylene and polypropylene). The majority of ethylene and propylene is produced by steam cracking, a process in which a fossil-based, hydrocarbon feed (composed primarily of naphtha, liquified petroleum gas (LPG), and/or ethane) is diluted with steam and heated in a furnace in the absence of oxygen to temperatures around 850° C. This process is highly endothermic, typically requiring ~60 GJ/ton of high value products. Conventional furnaces burn hydrogen (produced from the steam cracking process) and methane to meet this energy requirement, resulting in large emissions of $CO_2$. The continued dependence on both a fossil-based feedstock and fuel contributes greatly to the emissions of petrochemical operations.

Plastics account for roughly 12% of municipal solid waste in the U.S. and constitute a potential alternative/supplemental hydrocarbon feedstock. Specifically, polyolefins consist of long chains of carbons that, in atomic composition and arrangement, do not differ greatly from conventional fossil-based feedstocks, but do differ in average molecular weight (1000 s of g/mol vs. 100-200 g/mol, respectively). Polyolefins, as a feedstock, are attractive because they present a potential opportunity for closed-loop circular plastics.

Waste plastics can contain a number of both organic and inorganic contaminants from both their production (e.g. additives, pigments, metals, etc.) and their subsequent processing (e.g. paper, PVC, water, etc.). Plastics thus cannot be easily used directly as a supplemental or alternative feedstock to a steam cracker for the production of light olefins.

Pyrolysis can be an intermediate processing step to convert polyolefins to pyrolysis oil (or "py-oil"). This process breaks down polyolefins into liquid "py-oil" fractions (i.e., naphtha, diesel), solids (waxes), and lower molecular weight gases. Char/carbon is often a low-value byproduct of the process. The naphtha can then be fed to a conventional cracker to produce light olefins. The process typically occurs around 500° C., as higher temperatures can lead to side reactions, including aromatization. Conventional pyrolysis, however, struggles with fouling (from char) and contaminants (e.g. metals, PVC), which can become entrained in the liquid products, exceeding limits imposed by the steam cracker. As a result, efforts are underway to improve purification of the feed plastic as well as the pyrolysis oil.

SUMMARY

Oxidative cracking is an attractive route for the direct conversion of carbon-containing feedstocks (e.g., waste plastics, bio-based complex compositions, light alkanes, and municipal solid waste) into value-added basic chemical building blocks (e.g., olefins, oxo-compounds, and aromatics). The oxidative conversion of carbon-containing feedstocks reduces carbon dioxide emissions usually associated with heating requirements in the production of value-added basic chemical building blocks. One way to perform oxycracking relies on the use of a molten salt, and the present inventors have found that by including oxygen with the feedstock, improvements in process efficiency may be achieved.

In one aspect, a process is provided for the cracking of a carbon-containing feedstock to produce olefins, where the process includes contacting, in a reactor system, the carbon-containing feedstock with oxygen gas in the presence of a molten salt matrix consisting of a eutectic mixture of alkali metal carbonates, alkaline earth metal carbonates, or a mixture of any two or more thereof, to generate an olefin-containing product stream, and collecting an olefin from the olefin-containing product stream. In the process, the oxygen is fed with the carbon-containing feedstock in a gas stream comprising from greater than 0 wt % to about 21 wt % oxygen in an inert gas, and the process is conducted in the absence of: (i) a catalyst comprising a transition metal, a transition metal oxide, a rare-earth metal, a rare earth metal oxide, or a combination of any two or more thereof, and (ii) a glass-forming oxide. As used herein, glass-forming oxides include an oxides of silicon, boron, and phosphorus.

DETAILED DESCRIPTION

Figure 1:
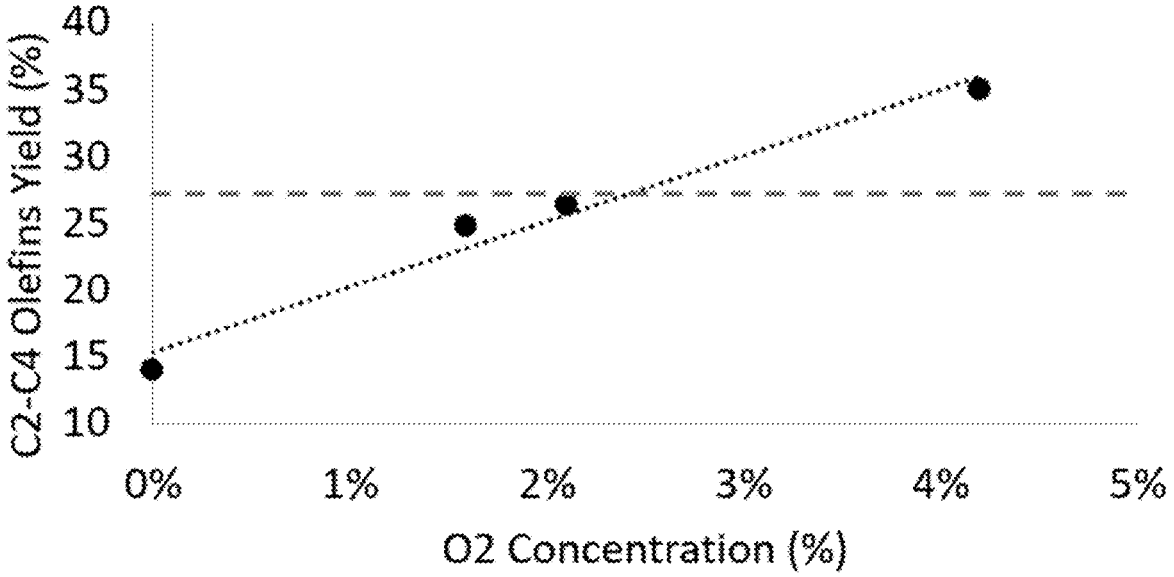
FIG. 1 is a graph of oxycracking yields for $C_2$-$C_4$ olefins at 600° C. as a function of oxygen content, according to the examples, where the dashed line represents a reference system having a transition metal in the eutectic mixture.

Various embodiments are described hereinafter. It should be noted that the specific embodiments are not intended as an exhaustive description or as a limitation to the broader aspects discussed herein. One aspect described in conjunction with a particular embodiment is not necessarily limited to that embodiment and may be practiced with any other embodiment(s).

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

The use of the terms "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein may be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

As used herein, the term "cracking" refers to a chemical process whereby a feedstock, i.e. complex organic molecules such as long-chain hydrocarbons, carbohydrates, or others are broken down into simpler molecules such as light hydrocarbons, oxygenates, or carbon oxides by the breaking of chemical bonds in the feedstock.

As used herein, the term "thermocracking" refers to a cracking process, whereby the conversion of feedstock to products is achieved by thermal energy transfer, i.e. heating, and, hence, it requires operating at elevated temperatures to proceed.

As used herein, the term "oxycracking" refers to a cracking process that utilizes a combination of thermocracking and oxidation processes, generally applied to the processing of heavy carbon-containing feedstocks, resulting in the formation of lighter hydrocarbons products, plus some amounts of organic oxygenates, CO, $CO_2$, and $H_2O$ as the co-products.

As used herein, the term "reactor system" refers to where the cracking reaction(s) take place. The process for cracking of hydrocarbons may occur in a single reactor or in at least two reactors in series.

As used herein, the term "carbon-containing feedstock" is not only purely hydrocarbon materials as would typically be associated with the term, including but not limited to petroleum feeds of a wide variety (including fossil fuel oils, naphtha, etc.), but the term also refers to any material having a carbon-containing segment within a plastic (i.e. polymer), biomass, or biowaste that is amenable to cracking by the processes provided herein. The carbon-containing feedstock may contain oxygen in the material, as well as other heteroatoms (N, S, Cl, etc.), colorants, plasticizers, and the like typically associated with polymers.

As used herein, the term a "eutectic" or "eutectic mixture" refers to a homogeneous mixture of substances that melt or solidify at a single temperature that is lower than the melting point of any of the constituents individually. It does not necessarily refer to the lowest melting point that is achievable with any particular mixture of substances, this is the eutectic point for those substances, and it may be part of the eutectic mixture. As long as a mixture of substances melts at a temperature lower than the melting point of any of its constituting pure substances, and forms a single continuous phase, it is a "eutectic" or "eutectic mixture" for the purposes of this disclosure.

It has now been found that the cracking of carbon-containing feedstocks may be conducted using a eutectic mixture of molten salts in the presence of oxygen to form a product stream containing olefinic and/or aromatic compounds.

In this regard, the process according to the present invention presents an alternative means of implementing pyrolysis by incorporating a molten salt media. As used herein, molten salt is added as a kind of "processing agent", thereby providing multiple benefits including improved heat transfer to the plastic particles as well as contaminant capture. The salt and trapped contaminants can potentially be purified later through physical (e.g. filtration) or chemical (e.g. re-oxidation) means.

The methods may be applied to carbon-containing feedstocks and includes recycling of olefinic polymers and biopolymers alike. The methods may be applied to pure hydrocarbon feedstock streams, as well as mixed streams, particularly where the hydrocarbon stream is from a mixed waste recycling operation. They hydrocarbons may be of a wide variety including petroleum-based streams of heavy or gaseous compounds, plastics, biomass, or biowaste. The described methods have the potential to deliver improved performance over industry accepted methods such as thermal pyrolysis, thermal-steam cracking, fluid catalytic cracking, and supercritical fluid cracking.

The processes described herein take advantage of autothermal or net exothermic cracking processes where the thermal demands for the process are met by all, or at least part of, the internally generated heat by taking advantage of the exothermic process, such as through combustion of hydrogen and partial combustion of the feed. Other accepted processes in the industry rely entirely on externally generated heat to achieve the desired conversion, and, because of this, are more energy and capital-intensive processes.

The processes described herein also tolerate the presence of acid impurities, such as those containing chloride, bromide, sulfide, and sulfate groups in the feed. The removal of such acid impurities is believed to occur through the absorption of such materials into the eutectic mixture, which is then purified, and the impurities removed. Thus, the process is feedstock flexible and can be used to process mixed plastic waste. The processes may also be operated as a continuous, semi-continuous, or batch processes. Thus, the process offers a high degree of flexibility for its end-user application design and operation. The carbon-containing feedstock may be injected into the reactor at either a bottom (i.e. it flows through the molten salt) or a top (i.e. it comes into contact at a surface of the molten salt) of the reactor.

In a first aspect, a process is provided for the cracking of a carbon-containing feedstock to produce olefins. The process includes contacting, in a reactor system, the carbon-containing feedstock with oxygen gas in the presence of a molten salt matrix consisting of a eutectic mixture of alkali metal carbonates, alkaline earth metal carbonates, or a mixture of any two or more thereof, to generate an olefin-containing product stream; and collecting an olefin from the olefin-containing product stream. In the process, the oxygen is fed, with an inert gas diluent, concurrently with the carbon-containing feedstock in the same feed stream or as separate a gas stream. The gas stream contains the oxygen from greater than 0 wt % to about 21 wt % oxygen, and the inert gas may include nitrogen, helium, or argon. The gas stream may be air, in some embodiments. In other embodiments, the gas stream contains the oxygen from greater than 0 wt % to about 8 wt % oxygen in inert gas.

It is also noted, importantly, that the process is to be conducted in the absence of a catalyst. Illustrative catalysts include transition metal, transition metal oxide, rare-earth metal, and rare earth metal oxide catalysts and any combination of two or more thereof. The process is also formed in the absence of a glass-forming oxides that include oxides of silicon, boron, and phosphorus.

As noted above, the eutectic mixture melts at a lower temperature than its constituent materials, and it melts at a temperature at which the catalytic reactions may be conducted to form desirable materials from a feedstock. The eutectic mixture of alkali metal carbonates may be a mixture of Li, Na, and K carbonates. In some embodiments, the eutectic mixture is one of $Li_2CO_3$, $Na_2CO_3$, and $K_2CO_3$.

In particular embodiments, the molten matrix containing a eutectic mixture of carbonates of Li and Na in a mole ratio of about 52:48, respectively, or a eutectic mixture of carbonates of Li and K in a mole ratio of about 62:38, respectively, or a eutectic mixture of carbonates of Li, Na, and K, in a mole ratio of about 43.5:31.5:25, respectively.

In some embodiments, the eutectic mixture of alkali metal carbonates has a melting point of less than about 800° C., or less than about 750° C., or less than about 650° C. This includes melting points from about 250° C. to about 650° C., from about 350° C. to about 550° C., or about 400° ° C. Other illustrative eutectic mixture of alkali metal carbonates includes those in Table 1, reproduced from Mutch et al. *J. Mater. Chem. A* 7, 12951-12973 (2019).

TABLE 1

Melting points of the individual alkali-carbonate salt compounds and their eutectic mixtures.

| Salt System | Melting Point (° C.) |
|---|---|
| $Li_2CO_3$ | 723 |
| $Na_2CO_3$ | 854 |
| $K_2CO_3$ | 891 |
| $Li_2CO_3$—$Na_2CO_3$ (52-48 mol %) | 501 |
| $Li_2CO_3$—$K_2CO_3$ (62-38 mol %) | 498 |
| $Na_2CO_3$—$K_2CO_3$ (56-44 mol %) | 710 |
| $Li_2CO_3$—$Na_2CO_3$—$K_2CO_3$ (43.5-31.5-25 mol %) | 397 |
| $Na_2CO_3$—$BaCO_3$ (52.2-47.3 mol %) | 686 |

In the process, a carbon-containing feedstock is injected into a reactor system where it comes into contact with the eutectic mixture and the co-feed of oxygen. An upper temperature limit within the reactor is defined by the need to preserve a substantial fraction of the carbon-carbon bonds of the feed from the thermo-pyrolytic decomposition. For example, for a polyethylene feed, the limit is defined by a ceiling temperature of about 610° C.

Pyrolysis reactions are known to take place primarily via radical-based reactions; Scheme 1 shows potential reaction pathways and propagation steps that lead to the formation of pyrolysis products. These reactions including a) initiation steps, in which a radical is initially formed by C—C cleavage, b) propagation steps, including b.i) b-scission, b.ii) H-shift, and b.iii) H-transfer steps, and c) termination steps, in which radicals are quenched. In radical-mediated reactions, the propagation steps b) occur at much faster rates than steps a) and c). As such, steps b) determine the product distribution and selectivity towards a given product, while steps a) and c) control the amount of product produced. This concept can be used to determine the role that $O_2$ plays in increasing yields of lighter products.

Scheme 1. Representative reactions in radical-mediated cracking/pyrolysis of hydrocarbons.

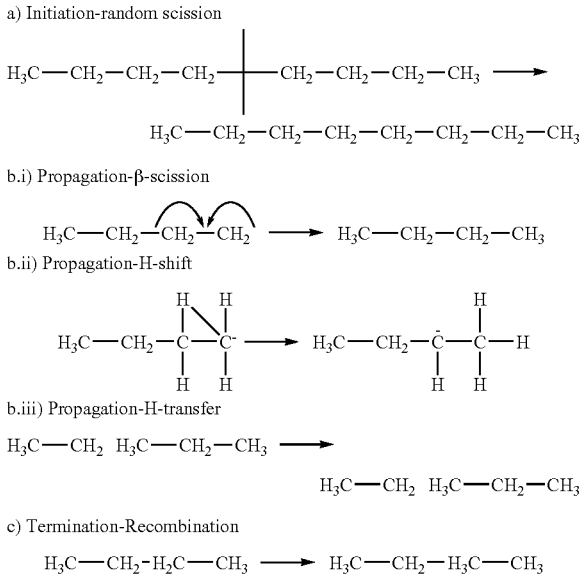

Without being bound by theory, oxypyrolysis likely enhances product yields through a H-abstraction step (Scheme 2), thereby initiating additional radicals that are able to also, like pyrolysis reactions, proceed through a series of propagation steps that result in a similar distribution of products, which in turn increases the yield toward desired light olefins. The results demonstrated here are applicable to a wide range of hydrocarbon feeds, whose only requirement are that they contain C—C bonds that can be cleaved to form a desired product.

Scheme 2.
Proposed initation reaction in the presence of $O_2$.

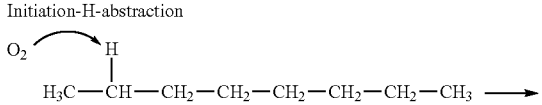

-continued

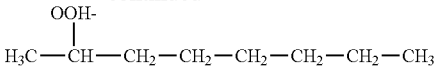

For those familiar with the art, a commercial process designed for thermocracking of polyethylene can operate at a temperature exceeding the ceiling temperature by 50-150° C. in order to achieve economically practical feed-to-monomers conversion rates. In the case of other feeds, the upper temperature limit is a function of the ceiling temperatures of the corresponding monomers, as given in the values in Table 2, reproduced from Stevens, M. P. Polymer Chemistry an Introduction (3rd ed.). New York: Oxford University Press. pp. 193-194 (1999), plus the additional 50-150° C. to achieve practical rates:

TABLE 2

Ceiling temperatures of common hydrocarbon monomers.

| Monomer | Ceiling Temperature (° C.) | Structure |
|---|---|---|
| ethylene | 610 | $CH_2{=}CH_2$ |
| 1,3-butadiene | 585 | $CH_2{=}CHCH{=}CH_2$ |
| isoprene | 466 | $CH_2{=}C(Me)CH{=}CH_2$ |
| styrene | 395 | $PhCH{=}CH_2$ |
| methyl methacrylate | 198 | $CH_2{=}C(Me)CO_2Me$ |
| isobutylene | 175 | $CH_2{=}CMe_2$ |
| α-methylstyrene | 66 | $PhC(Me){=}CH_2$ |

A lower temperature limit is defined by the need to maintain the molten salt in the liquid state. As an illustration, this is about 397° C. for the $Li_2CO_3$—$Na_2CO_3$—$K_2CO_3$ (43.5-31.5-25 mol %) eutectic mixture.

As noted above, the process provides for the production of olefinic and/or aromatic compounds from a carbon-containing feedstock. Because the carbon-containing feedstock may be from a wide variety of materials for process, including the processing of recycled plastics, biomass, biowaste, mixed plastics, biomass, refinery range hydrocarbons, and/or biowaste, the olefinic and/or aromatic compounds that are produced may include a wide variety of unsaturated compounds such as, but not limited to light olefins, α-olefins, terminal dienes, substituted and unsubstituted aromatic compounds, including single aromatic ring or several aromatic ring compounds.

Illustrative olefinic and/or aromatic compounds are from a wide range of materials. In some embodiments, the olefinic compounds may be from $C_2$ to $C_{20}$ olefins, from $C_2$ to $C_{16}$ olefins, or from $C_2$ to $C_{12}$ olefins, or from subranges of any of these. In some embodiments, the aromatic compounds may be from $C_6$ to $C_{18}$ aromatics, or from $C_6$ to $C_{12}$ aromatics, or from subranges of any of these. Illustrative olefinic and/or aromatic compounds include, but are not limited to, ethylene, propylene, 1-butylene, 2-methyl-but-1-ene, 1-n-pentene, 2-methyl-pent-1-ene, 3-methyl-pent-1-ene, 1,3-butadiene, 1,3-pentadiene, 1,4-pentadiene, 1,3-hexadiene, 1,4-hexadiene, 1,5-hexadiene, benzene, toluene, ethylbenzene, xylenes, styrene, α-methylstyrene, naphthalene, and anthracene.

As noted herein, the carbon-containing feedstock may include, but is not limited to, any one or more of a refinery range hydrocarbons, a polymer, a biopolymer, biomass, or biowaste. Where the feedstock includes a polymer, illustrative polymers include, but are not limited to those such as polyethylene, polypropylene, polyisobutylene, polybutadiene, polystyrene, poly-α-methylstyrene, polacrylates, poly (meth)acrylates, polyvinyl acetate, and polyvinylchloride. Where the feedstock includes a biopolymer or other bio-based material it may include materials such as fatty acids, triglyceride esters of fatty acids, cellulose, lignin, sugars, animal fat, tissue, and ordure.

Refinery range hydrocarbons are typically defined by their boiling point range fractions. For example, light naphtha has an approximate boiling point range of 25 to 85° C., heavy naphtha has an approximate boiling point range of 85 to 200° C., kerosene has an approximate boiling point range of 170 to 265° C., gas oil has an approximate boiling point range of 175 to 345° ° C., and heavy residue has an approximate boiling point range of 345 to 656° C. All of these may serve as the feedstock for a refinery range hydrocarbon. In some embodiments where the feedstock includes a refinery range hydrocarbon, it may include asphalt, vacuum resid, heavy residual oil, paraffin wax, lubricating oil, diesel, kerosene, naphtha, or gasoline. In some embodiments, the feedstock may include n-hexane, n-hexadecane, or white mineral oil.

In the process, the temperature inside the reactor system is dependent upon the composition of the carbon containing feed and the desired reaction products. Accordingly, the temperature may be from the melting point of the eutectic mixture of alkali carbonates up to about 1000° ° C. This may include a temperature from about 250° ° C. to about 750° ° C. In some embodiments, the contacting in the process is carried out at a temperature of less than 650° C. This may include, but is not limited to, a temperature of about 600° C. or less, such as about 450° C. to less than 650° C., or at about 600° C.

In the process, the pressures inside the reactor system may be low by comparison to other similar processes. For example, the pressure may be from about 0.5 atm (atmospheres) to about 2 atm, but it is preferably carried out at atmospheric pressure.

In the process, the residence time is a measure of how long the feedstock and products remain within the reaction on an average basis. In some embodiments, the residence time for the process is about 1 minute to about 15 minutes.

The reactor system for the proof of concept was a batch reactor and a stirred tank reactor. However, other suitable reactor configurations are considered such as falling film column reactors, packed column reactor, plate column reactor, spray tower reactor, and a variety of gas-liquid agitated vessel reactors. The process may be carried out as a batch process or in a continuous process.

In one embodiment according to the present invention, the oxidative pyrolysis of polyethylene (PE) and polypropylene (PP) was performed in the presence of a molten salt (a eutectic mixture of $Li_2CO_3$, $K_2CO_3$, and $Na_2CO_3$). The introduction of oxygen to PE-pyrolysis reactions significantly augmented product yields presumably by an increase in radical initiations. This enhancement was most significant under mild reaction conditions (500-600° C.), and the concentration of oxidant (oxygen/feed ratio) was shown to be a key parameter to maximize the formation of desirable hydrocarbon products. Additionally, the application of a molten salt—used as a processing agent—was shown (1) to improve heat transfer to the reaction and (2) to aid in the capture of contaminants (e.g., HCl) while pyrolyzing waste plastic. Ultimately, these advancements look to improve the viability of pyrolysis for the conversion of plastics into chemicals.

The process according to the present invention presents an alternative means of implementing pyrolysis by incorporating a molten salt media and oxygen into the reactor. The addition of oxygen (typically from air; 21% $O_2$) to the process, possibly through bubbling through the molten salt or other means, further enhances the process through internal heat generation, rendering the overall reaction exothermic (thereby decreasing external heat input requirements), but also increases yields towards light olefins and oils (decreasing waxes and solids) compared to pyrolysis by enhancing (increasing) the radical reactions that can propagate and selectively product light olefins. The process according to the present invention demonstrated here thus shows that the addition of oxygen can be used to increase yields of products at equivalent residence times, thereby reducing reactor size and recycle stream requirements. The process differs from our previously reported "oxycracking" system in that it does not require (but may still include) the addition of a reducible metal oxide, which provides oxygen to the system through a reduction reaction rather than directly through $O_2$.

The present invention, thus generally described, will be understood more readily by reference to the following examples, which are provided by way of illustration and are not intended to be limiting of the present invention.

EXAMPLES

Example 1. Paraffin waxes were melted at 90-120° C. and fed as a liquid onto a bed of a molten salt eutectic mixture (i.e. a mixture of lithium carbonate, potassium carbonate, and sodium carbonate) into a lab-scale continuously stirred tank reactor ("CSTR"). The molten salt was maintained at temperatures between 500-700° C. Optimal results for the paraffin feed used, were obtained at about 600° C. Feed rates of the paraffin wax were between 0.1 g/min to about 0.5 g/min. Oxygen was introduced into the system at greater than 0% to about 8% concentration (balanced with nitrogen) at a total gas flow rate of 500 mL/min. The resulting mass ratio of $O_2$:paraffin was from 0 to 0.25. The contents of the CSTR were stirred using an impeller at 300 rpm.

Figure 2:
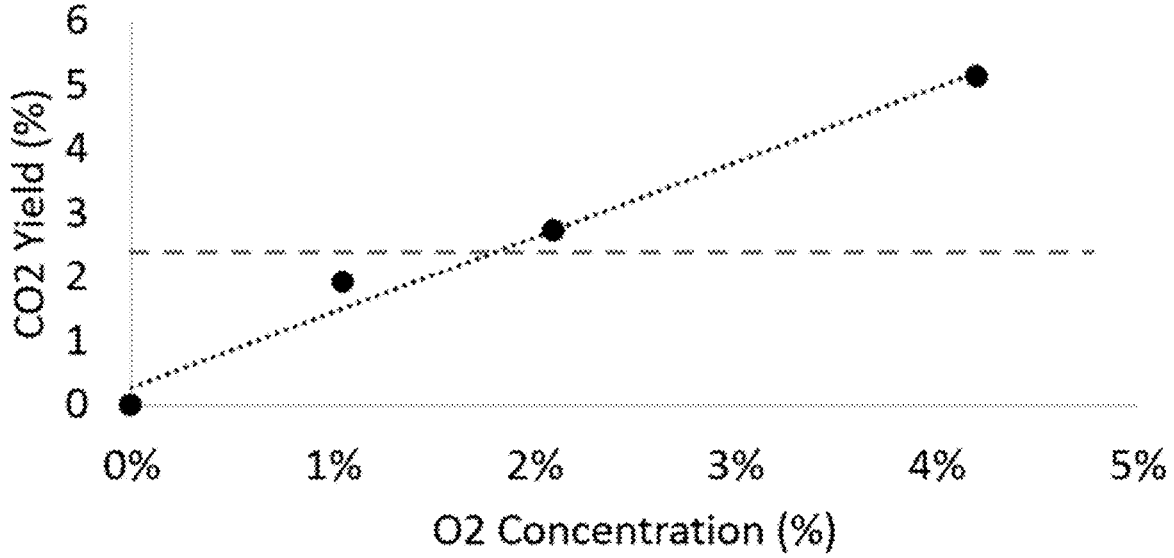
FIG. 2 is a graph of oxycracking carbon dioxide yields at 600° C. as a function of oxygen content, according to the examples, where the dashed line represents a reference system having a transition metal in the eutectic mixture.
Figure 3:
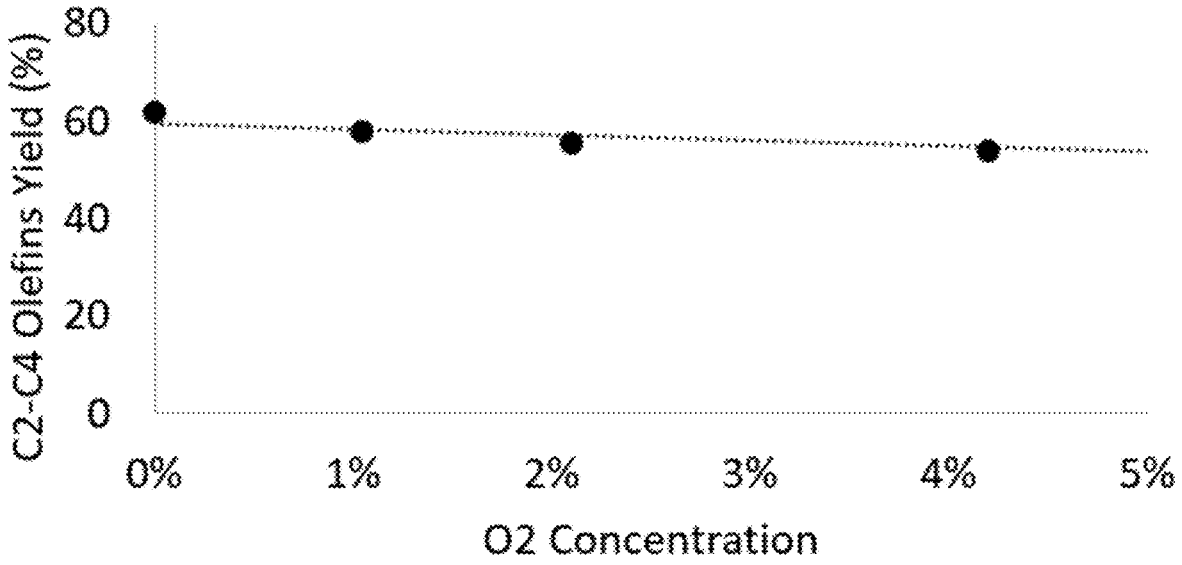
FIG. 3 is a graph of oxycracking yields for $C_2$-$C_4$ olefins at 650° C. as a function of oxygen content, according to the examples.

Olefin yields increased with $O_2$ concentration at temperatures below 650° C. See FIGS. 1 and 2. At higher temperatures, $O_2$ reacted with the olefins to form $CO_2$, and yields of olefins were observed to decrease (FIG. 3). FIG. 1 shows a comparison of yields between a reference system having a transition metal in the eutectic mixture (dotted line) to an inventive oxycracking system, where the olefin yields of the inventive oxycracking system increased by about 7% relative to the yield of the reference system. FIG. 2 shows $CO_2$ yields increasing as a function of oxygen concentration, but disproportionately with olefin yield, indicating a synergistic effect. FIG. 3 shows the improvement in yields tends to diminish once a temperature of 650° C. is reached.

Alternatives: Paraffin waxes are used in Example 1 as a model for heavy hydrocarbons and polyethylene feeds. They can be introduced presumably in any phase; with solids requiring additional energy input that may be compensated by increased oxidation. The feed may be introduced from the bottom of the reactor to increase contact time.

Example 2. Generation of olefinic monomers from different types of hydrocarbon feedstocks. The molten salt used here is composed of a eutectic mixture of $Li_2CO_3$ (32.1 wt %), $K_2CO_3$ (34.5 wt %), and $Na_2CO_3$ (33.4 wt %), as described in the patent WO 2021/243282. Such a eutectic mixture minimizes the melting point (~397° C.), enabling a wide range of operating temperatures between 400° C. and 800° C. Four types of hydrocarbon feeds were used in the following studies: 1) hexadecane (nC16), 2) paraffin wax, 3) high density polyethylene (HDPE, MW: ~75000 g $mol^{-1}$), 4) polypropylene (PP, MW: ~220000 g $mol^{-1}$).

Continuous flow studies were conducted using a ~5 L continuously stirred reactor (CSTR) containing 2 kg of the molten eutectic salt. Gas feeds (0.250-2 L $min^{-1}$) were introduced through a dip tube to the bottom of the molten salt bed, while liquid feeds were introduced using an ISCO syringe pump through either the same dip tube or through a secondary tube approaching the top of the molten salt bed. Polyolefin feeds (HDPE, PP) were introduced using the liquid dip tube by first heating the polymers in the ISCO syringe pump to 180° ° C. for HDPE and 220° C. for PP. The CSTR was heated using an electric furnace. All lines after the reactor were heated to a minimum temperature of 220° C. to prevent condensation of products. Product analysis and quantification was performed using gas chromatography.

Hexadecane (0.48 g $min^{-1}$), paraffin wax (0.1 g $min^{-1}$), and polymers (HDPE and PP; 0.48 g $min^{-1}$) were fed to the CSTR in the presence or absence of an $O_2$ cofeed to determine the effects of $O_2$ on product yields. Hexadecane was tested here as a lighter hydrocarbon-based feed that may be representative of a naphtha-like fossil-based feed. $O_2$ is expected to react non-catalytically with the hydrocarbons to form CO and $CO_2$ at the reaction temperatures investigated here (450-600° C.). In the absence of reaction synergies (between hydrocarbon oxidation and cracking reactions), $O_2$ would not be expected to change yields of other products except to the extent that some are consumed to form CO and $CO_2$. Table 3 shows the product distribution from nC16 from the reactor at 600° C. in the absence and presence of $O_2$ (5% $O_2$ mixture in $N_2$) (0.95 L $min^{-1}$ gas inlet). These data show that the product yields of all identified gases (C1-C4 products) increase in the presence of $O_2$, even as some carbon is consumed to form CO and $CO_2$. These gaseous products increase primarily at the expense of heavier hydrocarbons (C5+), in contrast with expectations of non-synergistic reactions; these data thus show evidence of interactions between carbon oxidation intermediates and cracking reactions. Tables 4-6 show similar results for paraffin wax, HDPE, and PP feeds.

TABLE 3

Hexadecane (0.48 g $min^{-1}$) mass yields at 600° C. in the absence and presence of 5% $O_2$.
Hexadecane Mass Yields

| | Carbon Mass Yield (%) | |
|---|---|---|
| Product | $N_2$ | 5% $O_2/N_2$ |
| Methane | 8.9% | 10.6% |
| Ethane | 6.1% | 6.4% |
| Ethylene | 23.8% | 28.1% |
| Propane | 0.7% | 0.7% |
| Propylene | 17.6% | 18.8% |
| n-Butane | 0.1% | 0.1% |
| Butenes | 4.7% | 8.0% |
| Butadiene | 4.2% | 4.2% |
| Liquids/Solids (C5+) | 30.5% | 10.7% |
| Aromatics | 3.4% | 5.6% |
| CO | 0.0% | 4.5% |
| CO2 | 0.0% | 2.3% |

TABLE 4

Paraffin wax (0.1 g $min^{-1}$) mass yields at 600° C. in the absence and presence of 5% $O_2$.

Paraffin Wax

| Product | Carbon Mass Yield (%) | |
|---|---|---|
| | $N_2$ | 5% $O_2/N_2$ |
| Methane | 1.4% | 4.3% |
| Ethane | 1.2% | 2.1% |
| Ethylene | 7.3% | 15.7% |
| Propane | 0.1% | 0.2% |
| Propylene | 6.4% | 11.6% |
| n-Butane | 2.2% | 0.0% |
| Butenes | 0.1% | 7.4% |
| Butadiene | 0.2% | 4.0% |
| Liquids/Solids (C5+) | 78.2% | 48.2% |
| Aromatics | 2.9% | 2.4% |
| CO | 0.0% | 0.8% |
| CO2 | 0.0% | 3.3% |

TABLE 5

HDPE (0.48 g $min^{-1}$) mass yields at 600° C. in the absence and presence of 5% $O_2$.

HDPE

| Product | Carbon Mass Yield (%) | |
|---|---|---|
| | $N_2$ | 5% $O_2/N_2$ |
| Methane | 1.8% | 3.5% |
| Ethane | 1.7% | 2.6% |
| Ethylene | 5.8% | 10.3% |
| Propane | 0.7% | 0.8% |
| Propylene | 6.1% | 9.3% |
| n-Butane | 0.4% | 0.4% |
| Butenes | 4.6% | 6.6% |
| Butadiene | 2.3% | 3.4% |
| Liquids/Solids (C5+) | 73.6% | 56.3% |
| Aromatics | 3.0% | 3.7% |
| CO | 0.0% | 1.2% |
| CO2 | 0.0% | 1.9% |

TABLE 6

PP (0.48 g $min^{-1}$) mass yields at 600° C. in the absence and presence of 5% $O_2$.

PP

| Product | Carbon Mass Yield (%) | |
|---|---|---|
| | $N_2$ | 5% $O_2/N_2$ |
| Methane | 4.5% | 4.8% |
| Ethane | 4.2% | 3.6% |
| Ethylene | 5.2% | 6.2% |
| Propane | 1.3% | 0.9% |
| Propylene | 17.1% | 16.6% |
| n-Butane | 0.3% | 0.2% |
| Butenes | 13.0% | 11.7% |
| Butadiene | 1.2% | 1.3% |
| Liquids/Solids (C5+) | 46.3% | 45.1% |

TABLE 6-continued

PP (0.48 g $min^{-1}$) mass yields at 600° C. in the absence and presence of 5% $O_2$.

PP

| Product | Carbon Mass Yield (%) | |
|---|---|---|
| | $N_2$ | 5% $O_2/N_2$ |
| Aromatics | 7.0% | 7.1% |
| CO | 0.0% | 1.2% |
| CO2 | 0.0% | 1.3% |

Figure 4:
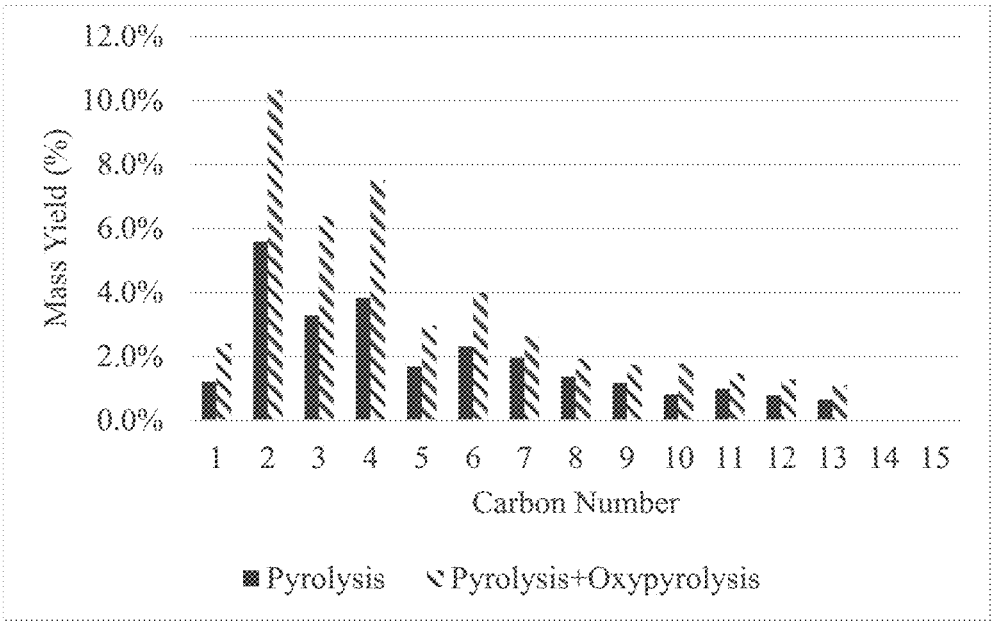
FIG. 4 is a graph of the mass yields from hexadecane in the absence (pyrolysis) and presence of oxygen (pyrolysis+oxypyrolysis) during reaction at 600° C. (0.48 g $min^{-1}$; 0.95 L $min^{-1}$ gas inlet), grouped by carbon number.

FIG. 4 shows the product yields grouped by carbon number for nC16 feeds. Product yields in the presence of $O_2$ can be considered a combination of pyrolysis reactions (always occurring in the background) and oxygen-assisted pathways (oxypyrolysis). The difference between yields therefore represents the contributions from oxygen-assisted pathway. By normalizing the yields from pyrolysis reactions and oxygen-assisted reactions, the mass selectivity towards each product can be compared (FIG. 5).

Figure 5:
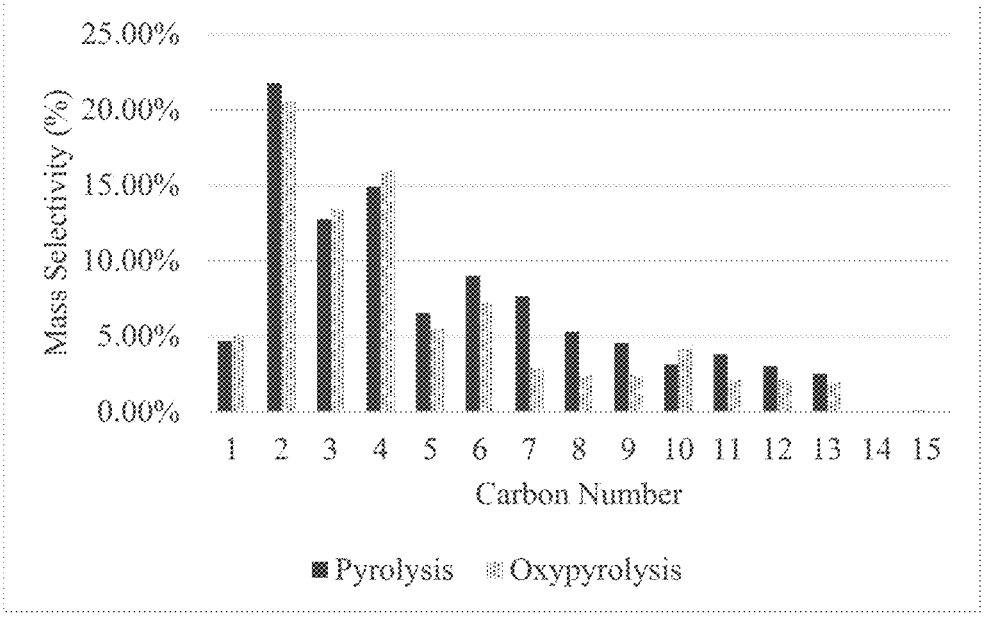
FIG. 5 is a graph of the mass selectivity from hexadecane for pyrolysis and oxygen-assisted pyrolysis (oxypyrolysis) pathways during reaction at 600° C. (0.48 g $min^{-1}$; 0.95 L $min^{-1}$ gas inlet), grouped by carbon number.

FIG. 5 shows that the mass selectivity of pyrolysis and oxypyrolysis reactions are extremely similar, reflective of similar reaction pathways. Such similarity in reaction product selectivity (FIG. 5) indicates that the reactions governing reaction selectivity in pyrolysis (steps b) in Scheme 1) and oxygen-assisted pyrolysis reactions are very likely the same. Oxygen-assisted pyrolysis reactions therefore likely occur via the same steps as pyrolysis (Scheme 1), but to a different extent in the presence of $O_2$. Because the propagation reactions (steps b) in Scheme 1) determine reaction selectivity and steps a) and c) determine the "amount" of product, the role of $O_2$ is likely either to enhance/increase the rate of initiation (step a)) or decrease the rate of termination (step c)). Of these two roles, the former is more likely to take place and has been reported in other researchers (Scheme 2).

Product yields and distributions can vary significantly with temperature. Pyrolysis is typically run at temperatures around 500° ° C. Such low temperatures, however, produce primarily liquid products. Temperature can also drastically change the relative rates of radical reactions steps (Scheme 1), changing the product selectivity. Higher temperatures are expected to favor radical propagation and thermally initiated (non-oxygen enhanced) reactions. The benefits of oxygen in enhancing yields may therefore decrease with increasing temperature. Product yields from HDPE were therefore measured as a function of temperature (550-700° C.) to determine these effects.

Table 7 shows product yields as a function of the reaction temperatures during pyrolysis ($N_2$, 0.95 L $min^{-1}$) and oxygen-assisted pyrolysis of HDPE (5% $O_2$ in $N_2$, 0.95 L $min^{-1}$). These data show that yields towards light products (less than $C_5$) increase as temperature increases, as expected from increased radical-mediated reactions, favored at higher temperatures. The data also show that these yields increase in the presence of $O_2$, again indicating increased contributions from oxygen-assisted pathways. It is also noted, however, that the relative increase in olefins yields (i.e. ethylene, propylene, butenes) is more pronounced at lower temperatures. This is likely because the benefits of oxygen-assisted pathways become less pronounced as thermally initiated pathways become dominant at higher temperatures. Thus, while the cofeed of $O_2$ can still be used to offset the energy requirements of pyrolytic cracking reactions, its interactions with radical reactions become less notable at higher temperatures. The optimum operating temperature for this system can be considered a complex function of residence time (which, in turn, affects yields), process energy requirements, and feed composition. Here, an operating temperature of 600° C. may be considered as an optimum as it enables oxygen-enhanced yields by $O_2$ while also having substantially higher yields than lower temperatures.

TABLE 7

HDPE mass yields as a function of temperature in the absence ($N_2$) and presence of $O_2$ (5%).

| | Temperature (° C.) | | | | | |
|---|---|---|---|---|---|---|
| | 550 | | 600 | | 650 | |
| Product | $N_2$ | 5% $O_2$ | $N_2$ | 5% $O_2$ | $N_2$ | 5% $O_2$ |
| Methane | 0.4% | 1.5% | 1.8% | 3.5% | 4.9% | 6.3% |
| Ethane | 0.7% | 1.3% | 1.7% | 2.6% | 3.0% | 3.4% |
| Ethylene | 1.5% | 5.0% | 5.8% | 10.3% | 15.1% | 17.0% |
| Propane | 0.6% | 0.8% | 0.7% | 0.8% | 0.8% | 0.8% |
| Propylene | 1.8% | 4.6% | 6.1% | 9.3% | 13.9% | 13.9% |
| n-Butane | 0.5% | 0.5% | 0.4% | 0.4% | 0.4% | 0.3% |
| Butenes | 1.6% | 3.7% | 4.6% | 6.6% | 8.6% | 8.0% |
| Butadiene | 0.9% | 2.2% | 2.3% | 3.4% | 4.0% | 3.6% |
| Liquids/Solids (C5+) | 91.6% | 77.6% | 73.6% | 56.3% | 43.7% | 34.7% |
| Aromatics | 0.4% | 0.5% | 3.0% | 3.7% | 5.6% | 8.2% |
| CO | 0.0% | 0.9% | 0.0% | 1.2% | 0.0% | 1.3% |
| CO2 | 0.0% | 1.4% | 0.0% | 1.9% | 0.0% | 2.5% |

Enhancements in product yield vary significantly with $O_2$/feed ratio. As such, product yields from HDPE and PP were also collected as $O_2$ feed concentration was varied (while maintaining a constant gas feed rate of 0.95 L $min^{-1}$ and polymer feed rate of 0.48 g $min^{-1}$); the results are shown in Table 8-9. These data show that increasing the $O_2$ concentration (and therefore the $O_2$/feed ratio) increases yields towards light products (up to 39% $O_2$/feed wt/wt) for HDPE. They indicate that increasing the amount of $O_2$ available also increases contributions from oxygen-assisted pyrolysis pathways, but at the expense of additional CO and $CO_2$ generation. Yields from PP are less affected by the amount of $O_2$. An amount of CO/$CO_2$ production is desirable from a process standpoint, as oxidation reactions are highly exothermic and can be used to balance the amount of heat required, but excess CO and $CO_2$ production is wasteful, as seen in the 55% $O_2$/feed results (Table 8). Thus, an optimum amount of Oz/feed ratio exists for a given product distribution.

TABLE 8

HDPE (0.48 g $min^{-1}$) mass yields at 600° C. as a function of $O_2$ concentration (0.95 L $min^{-1}$ total gas feed).

| | $O_2$/feed Ratio (wt/wt) | | | | | | |
|---|---|---|---|---|---|---|---|
| Product | 0% | 7% | 10% | 13% | 26% | 39% | 55% |
| Methane | 1.8% | 2.6% | 3.3% | 3.5% | 5.0% | 6.6% | 6.6% |
| Ethane | 1.7% | 2.2% | 2.6% | 2.6% | 2.8% | 2.9% | 2.5% |
| Ethylene | 5.8% | 7.9% | 9.9% | 10.3% | 12.8% | 15.9% | 12.0% |
| Propane | 0.7% | 0.8% | 0.9% | 0.8% | 0.8% | 0.7% | 0.5% |
| Propylene | 6.1% | 7.7% | 9.3% | 9.3% | 10.0% | 10.5% | 7.4% |
| n-Butane | 0.4% | 0.4% | 0.5% | 0.4% | 0.4% | 0.3% | 0.2% |
| Butenes | 4.6% | 5.6% | 6.8% | 6.6% | 6.4% | 6.5% | 3.9% |
| Butadiene | 2.3% | 2.8% | 3.4% | 3.4% | 3.3% | 3.2% | 2.0% |
| Liquids/Solids (C5+) | 73.6% | 65.5% | 58.0% | 56.3% | 46.1% | 34.5% | 43.4% |
| Aromatics | 3.0% | 3.2% | 3.0% | 3.7% | 4.2% | 5.6% | 4.9% |
| CO | 0.0% | 0.3% | 0.7% | 1.2% | 4.2% | 8.1% | 10.0% |
| CO2 | 0.0% | 1.0% | 1.6% | 1.9% | 4.0% | 5.2% | 6.7% |

TABLE 9

PP (0.48 g $min^{-1}$) mass yields at 600° C. as a function of $O_2$ concentration (0.95 L $min^{-1}$ total gas feed).

| | $O_2$/feed Ratio (wt/wt) | | | | | |
|---|---|---|---|---|---|---|
| Product | 0% | 7% | 10% | 13% | 26% | 39% |
| Methane | 4.4% | 4.6% | 7.3% | 4.8% | 6.4% | 7.1% |
| Ethane | 4.1% | 3.6% | 3.6% | 3.6% | 3.9% | 2.6% |
| Ethylene | 5.0% | 5.6% | 8.6% | 6.2% | 6.6% | 8.8% |
| Propane | 1.3% | 0.9% | 0.7% | 0.9% | 0.9% | 0.5% |
| Propylene | 16.7% | 15.4% | 14.9% | 16.6% | 14.7% | 13.3% |
| n-Butane | 0.3% | 0.2% | 0.2% | 0.2% | 0.2% | 0.1% |
| Butenes | 12.5% | 12.2% | 11.4% | 11.7% | 9.9% | 8.5% |
| Butadiene | 1.2% | 1.2% | 1.3% | 1.3% | 1.3% | 1.4% |
| Liquids/Solids (C5+) | 47.4% | 48.4% | 39.9% | 45.1% | 41.1% | 38.5% |
| Aromatics | 7.1% | 6.8% | 9.4% | 7.1% | 7.2% | 6.8% |
| CO | 0.0% | 0.4% | 1.3% | 1.2% | 4.1% | 7.3% |
| CO2 | 0.0% | 0.7% | 1.4% | 1.3% | 3.7% | 5.1% |

Figure 6:
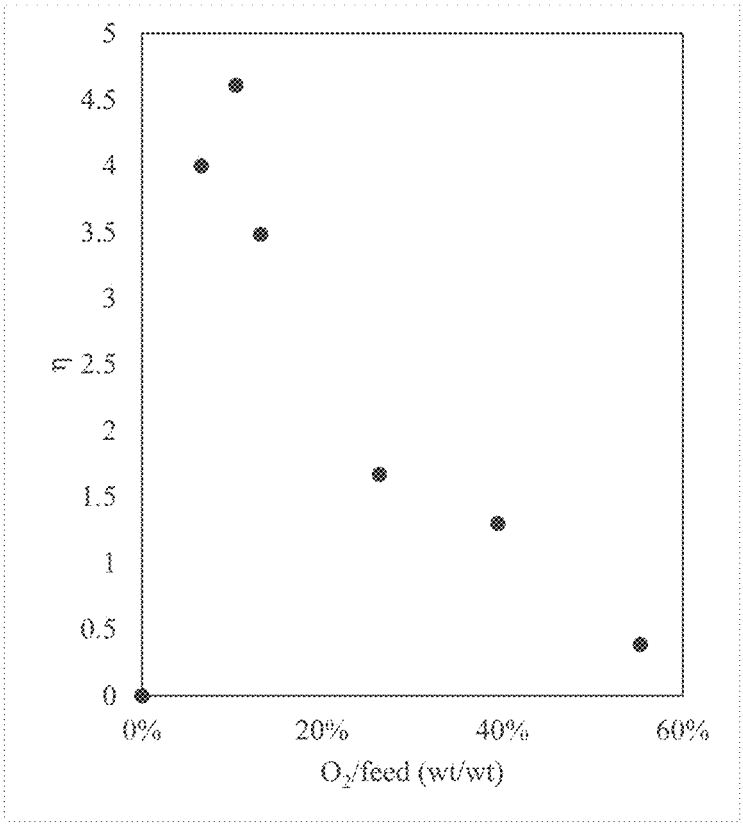
FIG. 6 is a graph representing the oxygen efficiency (n) as a function of $O_2$/feed ratio (wt/wt) for HDPE oxygen-assisted pyrolysis at 600° C. (0.48 g $min^{-1}$).

One possible way to determine an optimum in oxygen utilization is to define an oxygen efficiency:

$$\eta = \frac{\text{olefins enhancement}}{CO_x \text{ enhancement}}$$

as a function of the $O_2$/feed ratio. Here, the olefins enhancement is defined as the increase in mass yields towards $C_2$-$C_4$ olefins over pyrolysis, and $CO_x$ enhancement is the increase in mass yields towards CO and $CO_2$ over pyrolysis. These efficiency values are shown as a function of $O_2$/feed ratio in FIG. 6; they show that an optimum value exists around 10% $O_2$/feed (wt/wt) for this system. This value represents the highest improvement in olefins yields with the lowest corresponding increase in CO and $CO_2$ generation and represents an optimum in carbon and oxygen utilization. The overall process optimum, however, must also consider energy inputs and possible differences in product distributions as functions of other process parameters (e.g. residence time, temperature, etc.).

Example 3. Thermogravimetric analysis (TGA) was performed using a Mettler Toledo TGA/DSC 3+. Analysis was performed on virgin high density polyethylene (HDPE), and a mixture containing 25 wt % virgin HDPE and 75 wt % eutectic salt mixture. Samples were placed in sapphire crucibles at atmospheric pressure and heated in air at 10 mL $min^{-1}$. The following heating procedure was performed for each sample: 1) heat from 25° ° C. to 120° C. at a rate of 10° C./min, 2) hold at 120° C. for 30 minutes in order to remove physisorbed water, 3) heat to 600° C. at 10° C./min, and 4) hold for 30 minutes.

Figure 7:
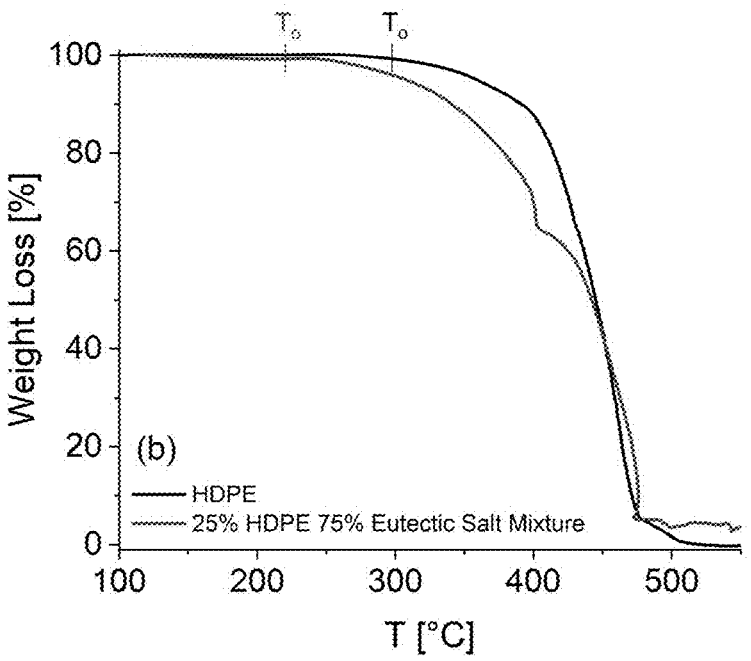
FIG. 7 is a graph representing the TGA curves in air of (dotted black) virgin HDPE and (dotted red) a mixture of 25 wt % HDPE and 75 wt % eutectic salt mixture. The TGA curves are normalized to the amount of HDPE loaded and disregard the residual mass of the salt.

TGA profiles were collected with and without a eutectic salt mixture. FIG. 7 shows the TGA profile for pure HDPE (black line in FIG. 7) and 25 wt % HDPE in 75 wt % eutectic salt mixture (red line in FIG. 7) under air flow. Weight loss corresponds to the decomposition of the HDPE polymer. The onset temperature (To) for mass loss is defined as the temperature in which 1% mass is loss. In the presence of air, To for virgin HDPE is 303° C.; this decreases to 250° C. when mixed with the eutectic salt. There is an increase in the acceleration of weight loss for the salt/polymer mixture compared to the virgin polymer. These data indicate that the salt aids in the breakdown of the polymer. Decomposition of the polymer in the salt/polymer mixture (red; FIG. 7) also occurs in two distinct events, which may indicate the interaction of oxygen with the molten salt mixture. The shift to lower decomposition temperature in the presence of the molten salt mixture may indicate improved heat transfer to the HDPE (and which occurs even in the absence of oxygen). We can deduce that accelerated heat transfer from the molten salt to the polymer is key for lowering the decomposition temperature and accelerating the rate at which it decomposes.

Example 4. The ability of the molten salt mixture to uptake chlorine contamination was studied by running pyrolysis reactions on pure PVC and PVC in the presence of a eutectic salt mixture. Reactions were run in a batch phase system under nitrogen at 450° ° C. for five minutes. The headspace was analyzed using GCMS and the gas phase products that are volatile up to 130° ° C. were analyzed. Powder x-ray diffraction patterns of the spent salt were collected to determine the presence of salt phases and compounds.

Decomposition of PVC occurs in two stages: the first occurs at low temperature where the chlorine is removed from the polymer backbone, and the second at higher temperature, where the polymer chain then decomposes. After the removal of chlorine, a hydrogen is abstracted from the polymer chain resulting in the formation of HCl. This also increases the tendency for the polymer to aromatize to produce benzene.

Figure 8:
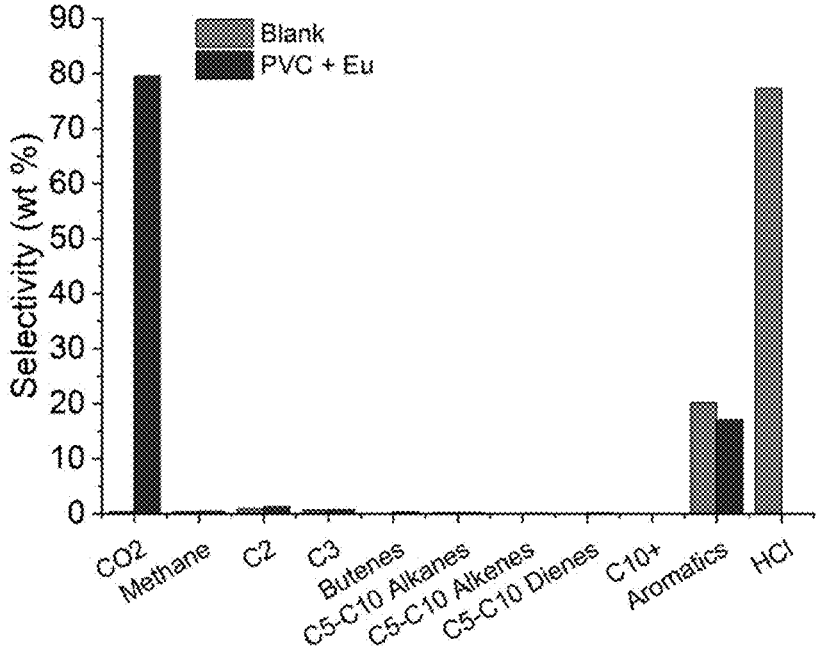
FIG. 8 is a graph of the gas phase product distribution of the pyrolysis of PVC (blank) and pyrolysis of PVC in the presence of eutectic salt mixture (PVC+Eu).
Figure 9:
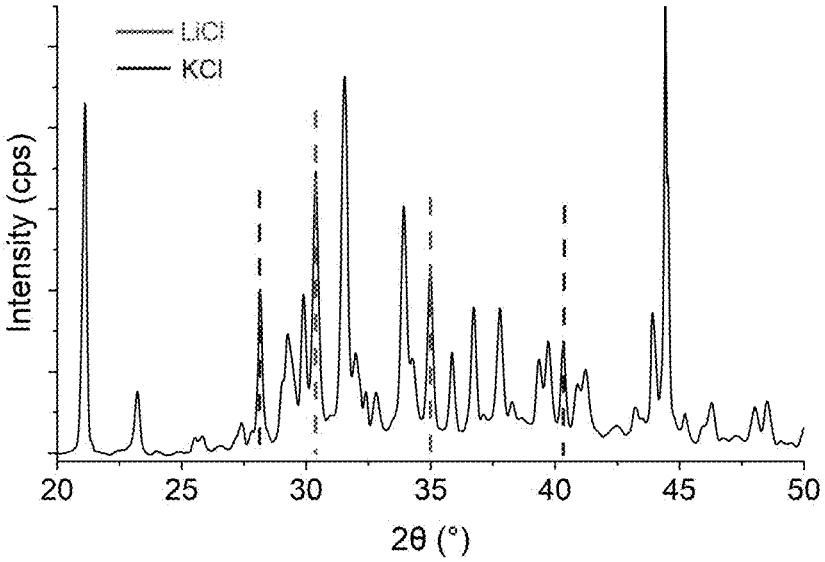
FIG. 9 is a XRD pattern of molten salt after reaction with PVC. The dashed lines indicate diffraction patterns corresponding to KCl and LiCl. The remaining diffraction peaks correspond to carbonates.

The ability of the salt to uptake chlorine contamination was studied by running pyrolysis reactions on pure PVC and PVC in the presence of a eutectic salt mixture. The gas phase product distributions are show in FIG. 8. These are the two major products in PVC pyrolysis in nitrogen. When the eutectic salt is added to the PVC, the major products become benzene and $CO_2$ with no selectivity towards HCl. This indicates that the salt is reactive in the presence of chlorine, exchanging carbonate ions with chlorine to form chloride salts and $CO_2$ as a byproduct. This is confirmed by the XRD pattern of the salt after it has been exposed to PVC, shown in FIG. 9, Diffraction peaks corresponding to KCl and LiCl can be seen (FIG. 9) with no evidence of $K_2CO_3$ present after reaction. However, diffraction peaks related to $Li_2CO_3$ are still present indicating that only parts of the salt react with chlorine.

The experimental data demonstrates that a molten salt can be used to aid in the processing of polymer feeds by improving heat transfer capabilities while also capturing some of these contaminants. Furthermore, the addition of $O_2$ can decrease energy requirements by combusting part of the feed while also improving light olefin yields by increasing radical reactions that facilitate the breakdown of long hydrocarbon chains. Such advancements enable pyrolysis to be a more viable technology for the preprocessing or single-step processing of waste plastics to high value chemicals.

While certain embodiments have been illustrated and described, it should be understood that changes and modifications may be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations may be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions, or biological systems, which can of course vary. It is also to be understood that the terminology used herein is for the purpose of describing particular embodiments only and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range may be easily recognized as sufficiently describing and enabling the same range being broken down into at least equal halves, thirds, quarters, fifths, tenths, etc. As a non-limiting example, each range discussed herein may be readily broken down into a lower third, middle third and upper third, etc. As will also be understood by one skilled in the art all language such as "up to," "at least," "greater than," "less than," and the like, include the number recited and refer to ranges which may be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed is:

1. A process for the cracking of a carbon-containing feedstock to produce olefins, the process comprising:

contacting, in a reactor system, the carbon-containing feedstock with oxygen gas in the presence of a molten salt matrix consisting of a eutectic mixture of alkali metal carbonates, alkaline earth metal carbonates, or a mixture of any two or more thereof, to generate an olefin-containing product stream; and collecting an olefin from the olefin-containing product stream;

wherein:

the oxygen is fed with the carbon-containing feedstock in a gas stream comprising from greater than 0 wt % to about 13 wt % oxygen in an inert gas;

the process is conducted in the absence of a catalyst comprising a transition metal, a transition metal oxide, a rare-earth metal, a rare earth metal oxide, or a combination of any two or more thereof; and the process is conducted in the absence of a glass-forming oxide.

2. The process of claim 1, wherein the eutectic mixture of alkali metal or alkaline earth metal carbonates consists of a mixture of Li, Na, and K carbonates.

3. The process of claim 1 which is a continuous process, a semi-continuous process, or a batch process.

4. The process of claim 1, wherein the reactor system comprises a continuously stirred reactor.

5. The process of claim 1, wherein the olefin comprises a $C_2$-$C_{12}$ olefin.

6. The process of claim 1, wherein the olefin comprises ethylene, propylene, 1-butene, 2-methyl-but-1-ene, 1-n-pentene, 1-n-hexene, 2-methyl-pent-1-ene, 3-methyl-pent-1-ene, 1,3-butadiene, 1,3-pentadiene, 1,4-pentadiene, 1,3-hexadiene, 1,4-hexadiene, 1,5-hexadiene, benzene, toluene, ethylbenzene, xylenes, styrene, α-methylstyrene, naphthalene, anthracene, or a combination of any two or more thereof.

7. The process of claim 1, wherein the olefin comprises ethylene or propylene.

8. The process of claim 1, wherein the contacting is conducted at a temperature of less than 650° C.

9. The process of claim 8, wherein the contacting is conducted at a temperature of about 600° C. or less.

10. The process of claim 8, wherein the contacting is conducted at a temperature of about 450° C. to less than 650° C.

11. The process of claim 8, wherein the contacting is conducted at a temperature of about 600° C.

12. The process of claim 1, wherein the inert gas comprising helium, argon, or nitrogen.

13. The process of claim 1, wherein the residence time for the process is about 1 minute to about 15 minutes.

14. The process of claim 1, wherein the carbon-containing feedstock is fed to the bottom of the reactor system.

15. The process of claim 1 which is carried out at a pressure of about 0.5 atm to 2 atm.

16. The process of claim 1 which is carried out at a pressure of about 1 atm.

17. The process of claim 1, wherein the carbon-containing feedstock comprises polyethylene, polypropylene, polyisobutylene, polybutadiene, polystyrene, poly-α-methylstyrene, polyacrylates, poly(meth)acrylates, polyvinylchloride, or polyethylene terephthalate.

18. The process of claim 1, wherein the carbon-containing feedstock comprises a refinery range hydrocarbon.

19. The process of claim 18, wherein the refinery range hydrocarbon comprises asphalt, vacuum resid, heavy residual oil, paraffin wax, pyrolysis wax, lubricating oil, diesel, kerosene, naphtha, gasoline, or a combination of any two or more thereof.

20. The process of claim 1, wherein the oxygen is fed to the reactor system in the gas stream comprising from greater than 0 wt % to about 8 wt % oxygen in an inert gas.

* * * * *